United States Patent [19]

Moscarillo

[11] 4,405,973

[45] Sep. 20, 1983

[54] EMERGENCY LIGHT SOURCES

[76] Inventor: Thomas L. Moscarillo, 59 S. Village Green, Ipswich, Mass. 01938

[21] Appl. No.: 239,360

[22] Filed: Mar. 2, 1981

[51] Int. Cl.[3] ..... F21K 2/00

[52] U.S. Cl. ..... 362/34; 362/190; 362/361; 362/368; 362/388

[58] Field of Search ..... 362/34, 190, 226, 347, 362/361, 368, 389, 397; 428/40

[56] References Cited

U.S. PATENT DOCUMENTS 1,739,641 12/1929 Lessmann ..... 362/397
3,700,879 10/1972 Franc ..... 362/389
3,894,225 7/1975 Chao ..... 362/389
4,184,193 1/1980 Heffernan ..... 362/34

*Primary Examiner*—Donald P. Walsh
*Attorney, Agent, or Firm*—Maurice R. Boiteau

[57] ABSTRACT

There is disclosed in the present application an emergency chemiluminescent light source including a container masked to reflect the emitted light toward an illuminated object and away from the viewer. The container, which is preferably of a two part plastic construction, includes a relatively flat base surface upon which an adhesive ring is provided for attaching the light source to the object to be illuminated.

5 Claims, 4 Drawing Figures

EMERGENCY LIGHT SOURCES

The present invention relates generally to improvements in chemiluminescent light sources but more specifically to containers for such light sources regardless of the chemical compositions by which the chemiluminescent effect is produced.

Under some circumstances there is a need for a light source at a minimal level, lasting an appreciable period of time, operable without requiring batteries or another source of electrical power and without presenting a fire hazard. One such situation, but certainly not the only one, occurs in sailing at night when a compact, low level light source is useful and when other light sources fail, especially for such purposes as reading a compass. In night sailing applications, it is advantageous to contain the light so that it does not cause night blindness which could result in serious accidents.

Another need existing in some low level light sources is that of maintaining the freedom of the user's hands to perform various tasks without requiring that the light source be held in illuminating position.

It is accordingly an object of the present invention to provide a light source which may be employed without affecting the night vision of the user.

Another object is a light source which is adapted to being used flexibly in various circumstances without interfering with the user's ability to use his hands.

Still another object is a to provide a compact light source usable either for direct or indirect lighting.

In the achievement of the foregoing objects, a feature of the invention relates to a chemiluminescent light cell in a container having an adhesive coated base by which it may be attached to an article to be illuminated. The container is shaped to hold a rupturable vial containing one of the chemiluminescence producing chemical components isolated from the other. The container thus retains the vial against displacement until it is broken to initiate the chemiluminescent action by mixing the two components of the light cell.

According to another feature, the container is covered with an opaque and reflective coating which directs the light output of the light cell through a clear base bearing the adhesive, to provide lighting of an object such as a compass without shining appreciable light into the eyes of the user. The opaque coating is preferably on the exterior of the container and strippable from the container so that illumination may be other than through the base.

The foregoing objects and features will be more fully understood and appreciated from the following detailed description of an illustrative embodiment of the invention taken in connection with the accompanying drawings in which.

Figure 1:
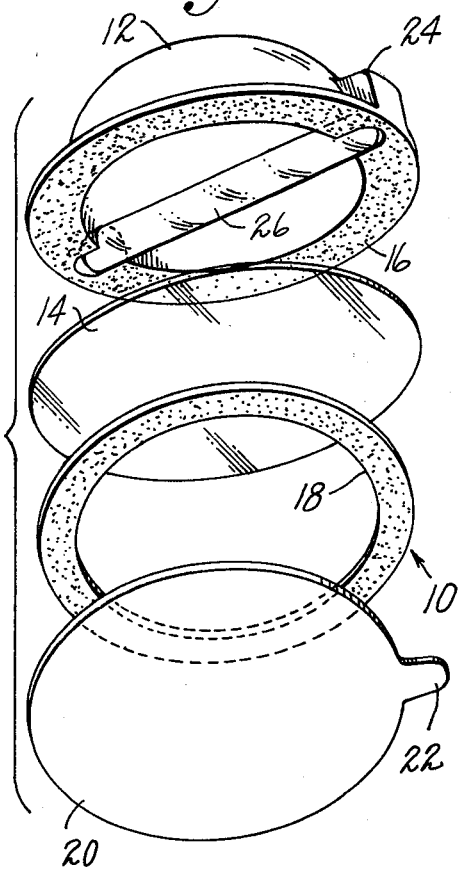
FIG. 1 is a view in perspective and with the parts depicted in separated relationship, of a chemiluminescent light cell according to the present invention.

Turning now to the drawings, particularly FIG. 1, there is shown a light cell indicated generally at 10 and comprising a dome 12 and a flat base 14 which, together, form the container for the light cell. In the drawings, the dome 12 and base 14 are shown with an adhesive coating 16 on their margins to seal them together but this may, in practice, be replaced by fusion of the parts together under heat and pressure. On the bottom of the base 14, there is a ring of adhesive 18 covered by a layer of release paper 20 provided with pull tab 22. Although the adhesive ring 18 is shown separated for clarity in FIG. 1, it is actually a coating on the bottom of the base, by which it may be attached to an object to be illuminated. The paper cover 20 serves to keep the adhesive free of an accumulation of foreign matter until the light cell is to be put to use. The dome 12 is formed with a pair of opposed indentations 24 into which a frangible elongated pod 26 is received to maintain it against displacement from a position in which it may be readily ruptured when needed to initiate the chemiluminescent light activity. The pod 26 contains one of the component chemicals and the dome outside the pod, the other of several well known chemicals adapted to produce chemiluminescence when mixed together.

Figure 2:
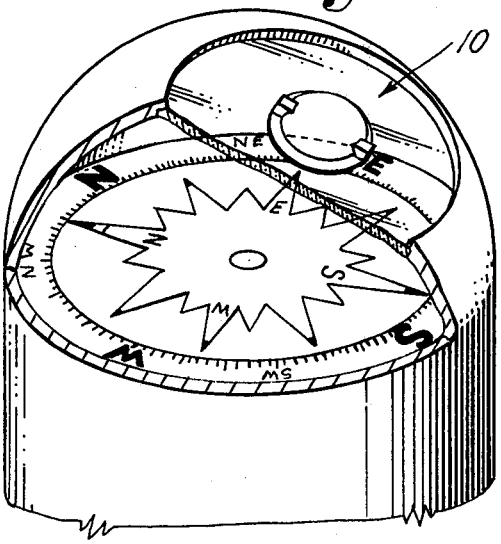
FIG. 2 is a view in perspective of a boat compass illuminated by the light cell depicted in FIG. 1.
Figure 3:
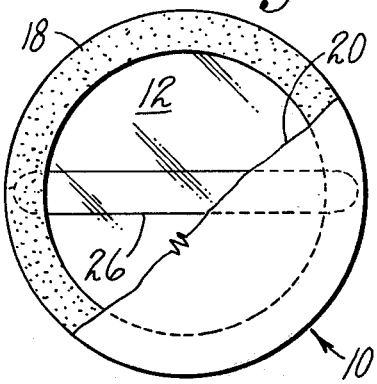
FIG. 3 is a bottom view of the light cell of FIG. 1.

The base 14 is preferably of a clear plastic material compatible with the chemiluminescence producing chemicals contained in the light cell 10. Thus, when the cell 10 is attached by its adhesive ring 18 to an article such as a compass housing, as seen in FIG. 2, the compass within the housing is illuminated by the light passing through the base 14. In order to enhance the illumination through the base and to shield the eyes of the user from the light if necessary, the exterior of the dome 12 receives an opaque reflective coating 28, such as is produced by metallizing, for example. The coating 28 may be locally stripped, as shown in FIG. 4, by the user with a dull scraping instrumentality whenever it is desired to direct the emitted light in a direction other than through the base 14.

Figure 4:
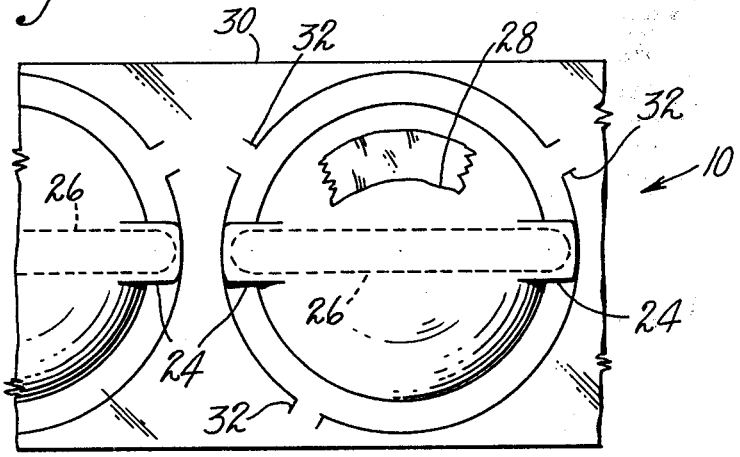
FIG. 4 is a plan view of a cell and a portion of another depicted in a strip in which they may be manufactured and shippped.

The manufacture of the cells 10 may advantageously be carried out in a strip 30, as shown in FIG. 4, by first forming the domes 12 in appropriate molds by heat and vacuum. While the domes are still in the strip 30, they may be filled with one of the chemicals, the pods 26 inserted, the bases 14 sealed to the domes, the adhesive rings 18 applied and covered with the release paper 22. For the convenience of the consumer in transporting and storing the cells 12, they may then be only partly severed from the strip 30, being retained in the strip by frangible bridges 32 until severed at the time of use.

From the foregoing description of an illustrative embodiment of the invention, many variations within its scope will become apparent to those of ordinary skill in the art. It is therefore not intended that the specification be taken in a limiting sense but rather that the scope of the invention be interpreted from the appended claims.

Having thus disclosed my invention, what I claim as new and desire to secure by Letters Patent of the United States is:

1. A light cell comprising a flexible plastic container including a generally dome shaped member, a generally flat base of transparent flexible plastic material sealed to the dome shaped member to form a liquid tight container, a frangible elongated glass pod containing a first chemiluminescence producing substance adapted to produce chemiluminescent light when mixed with a second substance substantially filling the container outside the pod, means including a pair of opposed indentations in the dome shaped member for retaining the pod against displacement from a position in which it may readily be ruptured by flexure of the container and means on the base including an adhesive covering part of the base for attaching the cell to an article to be illuminated, whereby light is directed onto the article through the transparent base.

2. A light cell according to claim 1 further comprising an opaque coating on the exterior of the dome shaped member for containing the light against passage except through the base.

3. A light cell according to claim 1 further characterized in that the exterior of the dome shaped member is covered by an opaque sprippable coating for containing the light output of the cell.

4. A light cell according to claim 3 further characterized in that the coating is reflective for directing the light output through the transparent base.

5. A light cell according to claim 1 further comprising a strip into which the cell is detachably retained as one of a plurality of like cells.

* * * * *